US006381772B1

(12) United States Patent
Dawson

(10) Patent No.: US 6,381,772 B1
(45) Date of Patent: May 7, 2002

(54) SHOWER SUPPORT SYSTEM

(76) Inventor: Lucille Dawson, 72 Annamaria Drive, Keswick, Ontario (CA), L4P-3R8

( * ) Notice: Subject to any disclaimer, the term of this patent is extended or adjusted under 35 U.S.C. 154(b) by 0 days.

(21) Appl. No.: 09/730,764

(22) Filed: Dec. 7, 2000

(51) Int. Cl.[7] ..... A47K 3/022

(52) U.S. Cl. ..... 4/578.1; 4/560.1; 4/571.1; 4/579

(58) Field of Search ..... 4/564.1, 565.1, 4/578.1, 579, 611, 559, 560.1, 566.1, 571.1

(56) References Cited

U.S. PATENT DOCUMENTS 4,498,204 A 2/1985 Warner ..... 4/559
4,998,305 A 3/1991 Davis ..... 4/604
5,590,427 A 1/1997 Weterings et al. ..... 4/611

FOREIGN PATENT DOCUMENTS

EP 402284 A1 * 12/1990 ..... 4/564.1

* cited by examiner

*Primary Examiner*—Michael Powell Buiz
*Assistant Examiner*—Tuan Nguyen
(74) *Attorney, Agent, or Firm*—Welsh & Flaxman LLC

(57) ABSTRACT

A support system to support a disabled person in a bathing environment, a pole mounted between the ceiling and the floor; a vertically adjustable, padded, underarm support, attached to the pole, to fit under the arms of a user at various selected heights; and a vertically adjustable seat attached to the pole.

8 Claims, 3 Drawing Sheets

10
18
14
4
4
36
47
34
30
28
38
42
26
48
22
16
47
48
32
38
34
36
12
5
5
58
50
69
72
54
60
64
52
72
24
50
54
69
58
72
64
12
51
56

SHOWER SUPPORT SYSTEM

BACKGROUND OF THE INVENTION

The present invention relates to a support system and in particular to a shower support system to aid persons with disabilities to stand and support themselves while showering.

Difficulties arise bathing disabled or handicapped persons, particularly in a shower where it is necessary for the incapacitated person to stand or sit in order to stay in the stream of water from the shower head. Often the disabled person requires the support of another individual. This eliminates privacy for the bathing person and also requires the supporting person to make provisions to stay dry from the water stream which impinges upon the disabled person. Structures to assist in the physical support of disabled or handicapped individuals while bathing are known in the prior art.

U.S. Pat. No. 4,498,204 to Warner is directed to an adjustable physical support system for handicapped persons including a telescoping rod arrangement in combination with horizontal bars which are vertically adjustable to aid a disabled individual while using a bathing or toilet facility.

Another U.S. Patent of interest is U.S. Pat. No. 4,998,305 to Davis which shows a shower apparatus for wheelchair bound invalids including a rotatable seat operable to transfer a disabled person from a wheelchair into a shower and/or a bath.

Still another patent of interest is U.S. Pat. No. 5,590,427 to Weterings et al. which shows a shower seat structure including pivotal hinged elements for moving the seat between a use and non-use position.

SUMMARY OF THE INVENTION

The present invention is an improvement of the prior art in the form of a support system to aid persons with disabilities and senior citizens to stand in a shower unassisted and totally supported. The system includes a stainless steel pole mounted between the ceiling and the floor. A padded underarm support attaches to the pole and is vertically adjustable to fit under the arms of a user of any height. A padded, waterproof adjustable seat is also included for more additional comfort. The seat is removable and also is vertically adjustable.

Among the objects of the present invention are the provision of a shower support system to assist a permanently disabled or senior person to easily perform the common daily function of bathing with dignity and privacy without the need of another individual for support.

Another object of the present invention is the provision of a support system which is permanently supported in a bathing environment while being completely adjustable to accommodate a wide variety of individual disabled users.

Other objects and advantages of the present invention will become apparent from the following detailed description when viewed in conjunction with the accompanying drawings, which set forth certain, non-limiting, embodiments of the invention.

DESCRIPTION OF THE PREFERRED EMBODIMENTS

Figure 1:
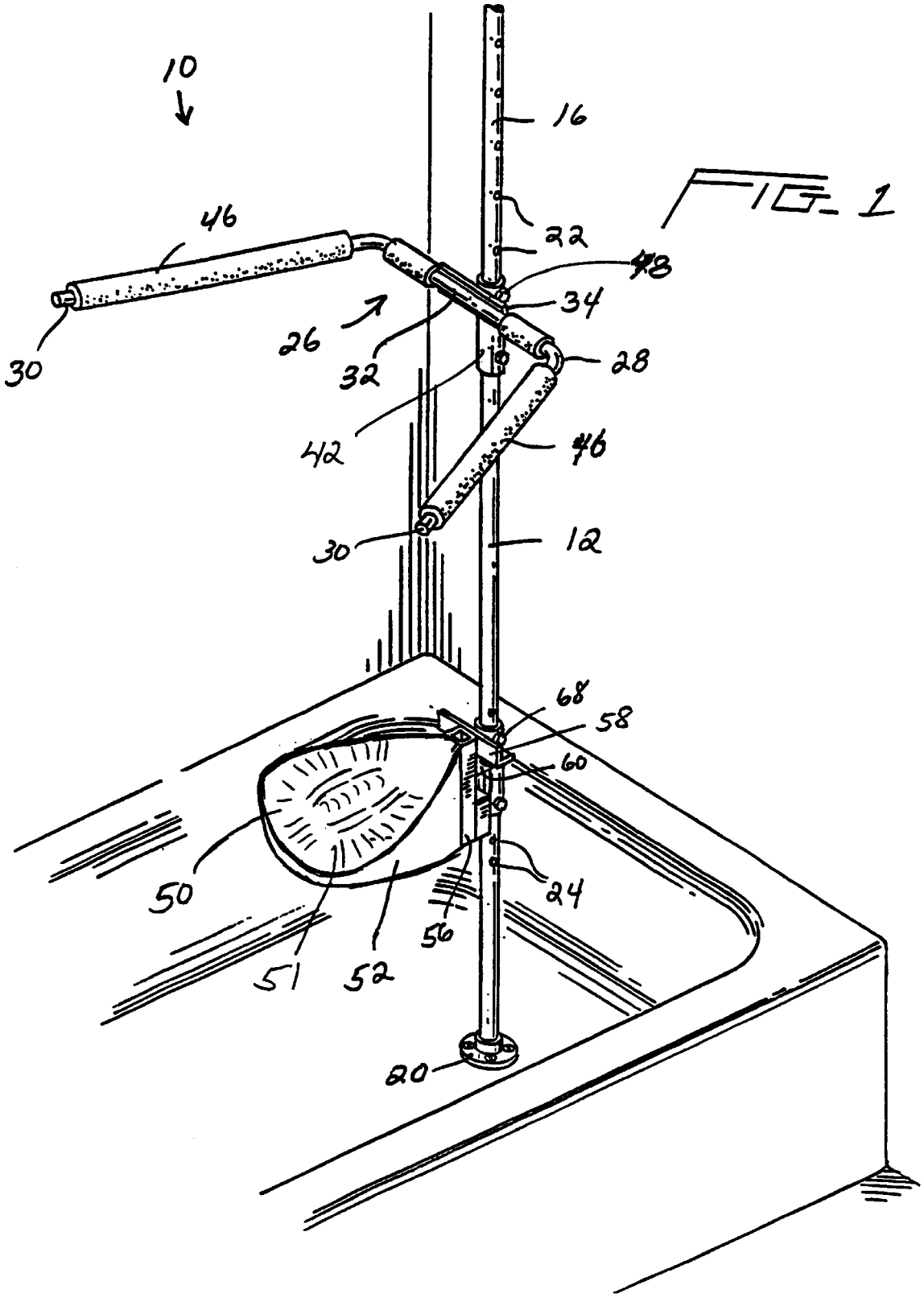
FIG. 1 is a perspective view of invalid support system of the present invention.
Figure 2:
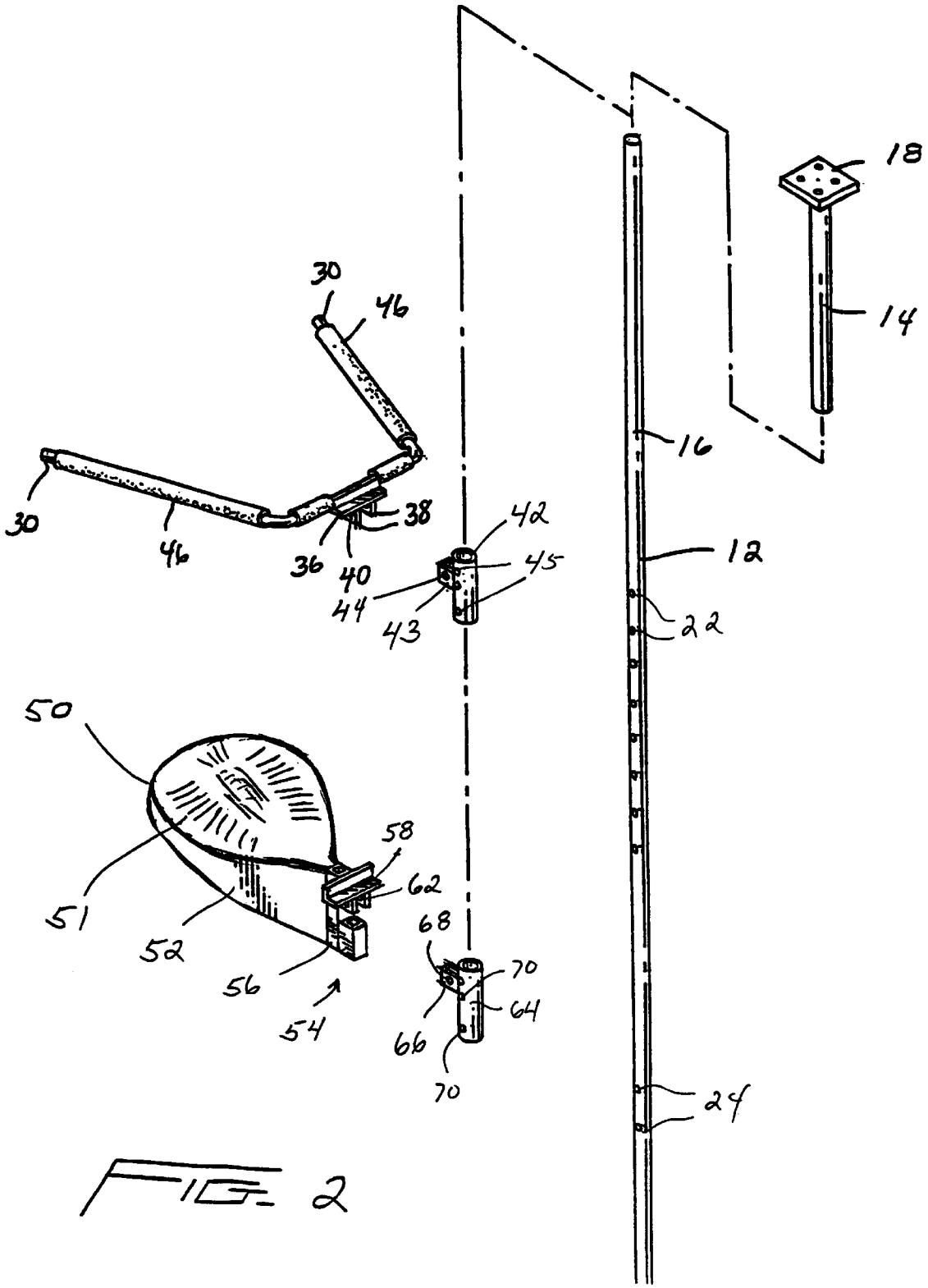
FIG. 2 is an exploded view thereof.
Figures 3, 4, 5:
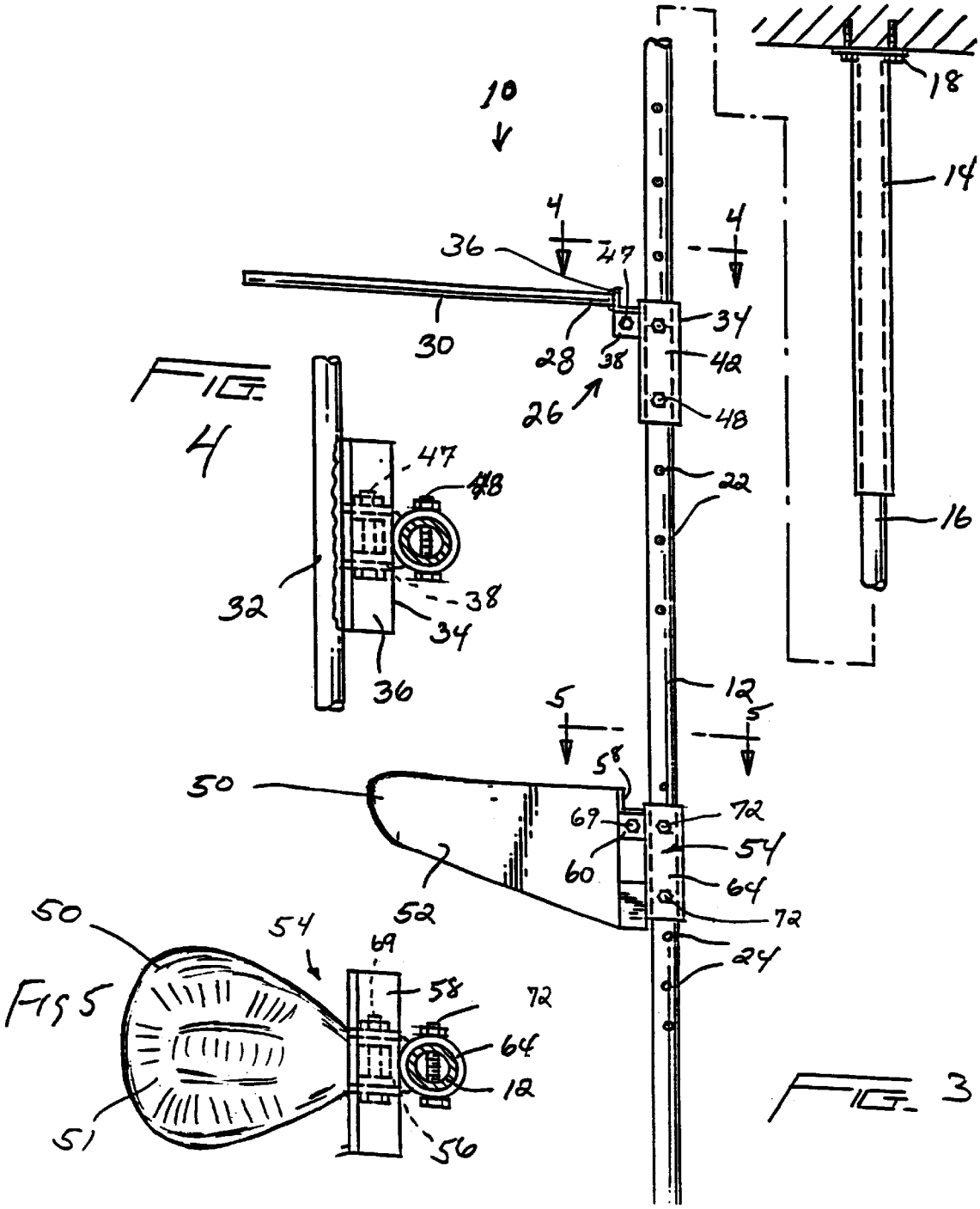
FIG. 3 is an elevational view of the support system.
FIG. 4 is a detailed view of the armrest mounting bracket of the present invention.
FIG. 5 is a detailed view of the seat mounting bracket of the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to the drawings the shower support system 10 of the present invention includes a stainless steel pole 12 preferably formed with two telescoping sections 14 and 16. Section 14 attached to the ceiling with a mounting plate 18 and section 16 to the tub or shower floor with a mounting plate 20. The pole 12 includes a plurality of armrest support positions, defined by bores 22 in the pole 12, vertically spaced at approximately three inch intervals.

The lower end of the stainless steel pole 12 also includes a plurality of seat mounting positions, in the form of bores 24, approximately 15 and 19 inches above the floor surface.

An armrest assembly 26 is made of a stainless steel, round bar 28 including a pair of splayed wing members 30 and a back bar 32 formed in a generally trapezoidal shape, the outermost ends of the wing members being the farthest apart. The wing members 30 are designed to fit under the arms of a user when the back of the user is located adjacent the back bar 32. The back bar 32 is welded to a pivotal mounting bracket 34 formed of an L-shaped support 36 having a pair of mounting flanges 38, with centrally located bores 40. Connected to the mounting flanges 38 is stainless steel sleeve 42 with a pivot plate 43 having a mounting bore 44 which aligns with bores 40 on the flanges 38. A mounting pin 47 provides a pivotal connection between pivot plate 43 and mounting flanges 38. The armrest assembly 26 may be pivoted upwardly against the pole 12 by pivoting the mounting bracket 34 on mounting pin 47.

A plurality of mounting bores 45 are provided on the sleeve 42 which correspond to the bores 22 on the pole 12. The stainless steel sleeve 42 is mounted on the stainless steel pole 12 by telescopically slipping the sleeve 42 over the pole 12 before it is attached to the floor or ceiling of the bathing structure. Once a preselected position is determined for the height of a particular user, mounting pin 48 are inserted through the mounting bores 45 on the sleeve 42 and through a corresponding bore 22 in the pole 12. It will be appreciated the mounting pins 48 are removable to allow upward and downward movement of the armrest 26 to accommodate different heights of individuals to be supported.

The wing members 30 of the armrest assembly 26 include a padded underarm support 46 slidable along the length of the wing member 30 to comfortably support the underarms of the user.

A contoured seat member 50, which may be padded for additional comfort, includes a seat surface 51, side support panels 52 and a pivotal mounting bracket 54. The bracket 54 is structured similar to the armrest bracket 34 and is formed of a square mounting tube 56 welded or otherwise attached to the innermost ends of the side support panels 52, an L-shaped support 58 having a pair of mounting flanges 60, each with centrally located bores 62 and a stainless steel sleeve 64 and pivot plate 66 having a mounting bore 68 aligned with the bores 62 on the flanges 60. A mounting pin 69 provides a pivotal connection between pivot plate 66 and mounting flanges 60. The seat 50 may be pivoted upwardly against the pole 12 by pivoting the mounting bracket 54 on mounting pin 69.

A plurality of mounting bores 70 are provided on the sleeve 64 which correspond to the bores 24 on the pole 12. The seat 50 is located at a preselected height position by mounting the stainless steel sleeve 64 on the stainless steel pole 12 by telescopically slipping the sleeve 64 over the pole 12 before it is attached to the floor or ceiling of the bathing structure. Mounting pins 72 are placed through the mounting bores 70 and corresponding bores 24 at the selected seat mounting position.

Because both the armrest and the seat may be pivoted against the pole 12, additional room is provided for a disabled person to ingress and egress from the bathing environment without being encumbered by the armrest or seat structure. Similarly, the armrest or seat may be selectively removed from the pole 12 by simply removing the mounting pins to provide additional room, when needed.

While various preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A support system to support a disabled person in a bathing environment, comprising:

a pole having a length for mounting between a ceiling and floor; a selectively, vertically adjustable, underarm support, structured to support the arms of said disabled person while in a standing position; said underarm support being adjustably attached to said pole; and, a separate, selectively, vertically adjustable seat being adjustably attached to said pole below said underarm support; said underarm support and said seat being independently adjustable from each other along the length of the pole to selected positions.

2. The support system of claim 1 further including a mounting bracket for pivotally securing said underarm support to said pole and a mounting bracket for pivotally securing said seat to said pole.

3. The support system of claim 2 further including a plurality of armrest support positions and a plurality of seat positions on said pole; said positions being defined by a plurality of bore openings vertically spaced along the length of said pole.

4. The support system of claim 3 further including pin members for connecting said mounting brackets to said bore openings on said pole.

5. The support system of claim 4 wherein said mounting bracket for said armrest support is formed of complementary sections; a first section being rigidly attached to said armrest support and a second section structured to be attached to said pole, including a sleeve slidable along the length of said pole; said sleeve having at least one bore opening positioned to be axially aligned with said bore openings on said pole to receive at least one of said pin members to locate said mounting bracket at a user selected position.

6. The support system of claim 4 wherein said mounting bracket for said seat is formed of complementary sections; a first section being rigidly attached to said seat and a second section structured to be attached to said pole, including a sleeve slidable along the length of said pole; said sleeve having at least one bore opening positioned to be axially aligned with said bore openings on said pole to receive at least one of said pin members to locate said mounting bracket at a user selected position.

7. The support system of claim 1 wherein said underarm support is formed of a back bar member and a pair of arm members splayed outwardly at an angle with respect to said back bar member, such that the outermost ends of the arms are further apart than the innermost ends connected to the back bar member.

8. The support system of claim 7 further including padding slidably attached to said arm members of said underarm support.

* * * * *